US010194223B2

(12) United States Patent
Fan et al.

(10) Patent No.: US 10,194,223 B2
(45) Date of Patent: Jan. 29, 2019

(54) LOUDSPEAKER MODULE

(71) Applicant: GOERTEK INC., WeiFang (CN)

(72) Inventors: Shuangshuang Fan, WeiFang (CN); Gang Chen, WeiFang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/568,404

(22) PCT Filed: Nov. 16, 2015

(86) PCT No.: PCT/CN2015/094675

§ 371 (c)(1),
(2) Date: Oct. 20, 2017

(87) PCT Pub. No.: WO2016/169257

PCT Pub. Date: Oct. 27, 2016

(65) Prior Publication Data

US 2018/0160206 A1 Jun. 7, 2018

(30) Foreign Application Priority Data

Apr. 22, 2015 (CN) ..... 2015 1 0193890

(51) Int. Cl.
*H04R 1/02* (2006.01)
*H04R 31/00* (2006.01)

(52) U.S. Cl.
CPC ..... *H04R 1/023* (2013.01); *H04R 1/025* (2013.01); *H04R 31/00* (2013.01); *H04R 2460/11* (2013.01); *H04R 2499/11* (2013.01)

(58) Field of Classification Search
USPC ..... 381/332, 333, 336, 345, 353, 354, 388, 381/373, 386
See application file for complete search history.

(56) References Cited

U.S. PATENT DOCUMENTS 8,757,317 B1 * 6/2014 Wang ..... H04R 1/345 181/153
2005/0077102 A1 * 4/2005 Banter ..... H04R 1/023 181/149

FOREIGN PATENT DOCUMENTS

| | | | |
|---|---|---|---|
| CN | 1356852 | A | 7/2002 |
| CN | 1459210 | A | 11/2003 |
| CN | 2765421 | Y | 3/2006 |
| CN | 201878318 | U | 6/2011 |

(Continued)

OTHER PUBLICATIONS

International Search Report for International Patent Application No. PCT/CN2015/094675, filed on Nov. 16, 2015.

*Primary Examiner* — Yosef K Laekemariam

(57) ABSTRACT

Disclosed is a loudspeaker module, comprising a housing and a loudspeaker unit accommodated in the housing. A sound hole is provided on the housing, and a protective net is provided at a position of the housing corresponding to the sound hole, wherein the protective net has a non-planar structure. In the loudspeaker module of the present invention, the protective net has a non-planar structure, and cancels, via deformation thereof, stress of the housing such that the stress does not act on the protective net to cause tearing or deformation of the net holes, thus improving reliability of the protective net, preventing external foreign matter from entering the interior of the loudspeaker module, and improving reliability of the loudspeaker module.

4 Claims, 2 Drawing Sheets

(56) References Cited

FOREIGN PATENT DOCUMENTS

| | | | |
|---|---|---|---|
| CN | 104822102 | A | 8/2015 |
| CN | 204616006 | U | 9/2015 |

* cited by examiner

LOUDSPEAKER MODULE

CROSS REFERENCE TO RELATED APPLICATIONS

The present specification is a U.S. National Stage of International Patent Application No. PCT/CN2015/094675 filed Nov. 16, 2015, which claims priority to and the benefit of Chinese Patent Application No. 201510193890.7, filed in the Chinese Intellectual Property Office on Apr. 22, 2015, the entire contents of which are incorporated herein by reference.

TECHNICAL FIELD

The present invention relates to the field of electro-acoustics, and more particularly to a loudspeaker module with high reliability.

BACKGROUND

With the expansion of consumer electronics market, a large number of consumer electronics, such as mobile phones, notebook computers and the like, have been widely promoted. The loudspeaker module has been widely used as an important acoustic component in consumer electronics. With the improvement of the quality requirements on consumer electronics, the reliability of the loudspeaker module has also been highly spotted.

The loudspeaker module comprises a housing and a unit, and the housing is provided with a sound hole for radiating sound. In order to prevent the foreign matter from entering the interior of the loudspeaker module, a protective net is provided at a position of the sound hole of the loudspeaker module. During the production and application process of the loudspeaker module, the housing will inevitably be applied with external forces. When the housing is applied with a certain external force, such as due to ultrasound, drop, or vibration, the housing will deform to a certain extent, or the housing deforms due to a certain stress relief thereof. When the housing deforms, the protective net provided on the housing will be subjected to stress, causing deformation of the net holes of the protective net or tearing of the protective net. Thus, the protective net can not function to prevent foreign matters from entering the interior of the loudspeaker module, resulting in the decline of the reliability of the loudspeaker module.

Therefore, it is necessary to propose an improvement to overcome the shortcomings of traditional loudspeaker modules.

SUMMARY

A technical problem to be solved by the present invention is to provide a loudspeaker module having a high reliability.

In order to achieve the above objective, the present invention adopts the following technical solution:

A loudspeaker module comprises a housing and a loudspeaker unit accommodated in the housing. A sound hole is provided on the housing, and a protective net is provided at a position of the housing corresponding to the sound hole, wherein the protective net has a non-planar structure.

As a preferred embodiment, the protective net has an arc shape or a wavy shape.

As a preferred embodiment, the protective net is adhesively fixed to the housing.

As a preferred embodiment, the housing is provided with a bonding surface at a bonding position corresponding to the protective net, a portion of the protective net contacting with the housing has as shape corresponding to a shape of the bonding surface, and a colloid is provided between the protective net and the bonding surface.

As a preferred embodiment, the protective net is integral with the housing through injection molding.

As a preferred embodiment, the protective net and the housing are fixed by ultrasonic welding.

As a preferred embodiment, the protective net is provided on the inner side of the housing close to the loudspeaker unit.

As a preferred embodiment, the protective net is a metal net.

In the loudspeaker module of the invention, the protective net has a non-planar structure. When the protective net is applied with the stress of the housing, the non-planar structure of the protective net can offset the stress through a tiny structure deformation thereof so as to avoid the tearing of the protective net or deformation of the net holes due to the stress of the housing, thereby ensuring the reliability of the loudspeaker module.

In order to improve the deformation of the protective net so as to improve the effect of offsetting the stress of the housing, the protective net can have an arc shape or a wavy shape.

In order to improve the firmness of the bonding between the protective net and the housing, the protective net is adhesively fixed to the housing, the housing is provided with a bonding surface corresponding to the protective net, and the protective net and the bonding surface have a corresponding shape and are bonded through the colloid.

In order to improve the firmness of the bonding between the protective net and the housing and simplify the production process of the loudspeaker module, the protective net and the housing can be integrally injection-molded, or be fixed by ultrasonic welding.

The protective net is provided inside the housing, which can avoid scratches on the protective net when the loudspeaker module is assembled and improve the aesthetics of the loudspeaker module.

The protective net is a metal net, which can improve the firmness of the protective net and further improve the reliability of the loudspeaker module.

In view of the above, the loudspeaker module of the present invention has the advantage of high reliability.

DETAILED DESCRIPTION OF THE PREFERRED EMBODIMENTS

The contents of the present invention will be described in detail with reference to the accompanying drawings.

Embodiment 1

The loudspeaker module of the present invention comprises a housing and a loudspeaker unit. As shown in FIGS.

Figure 1:
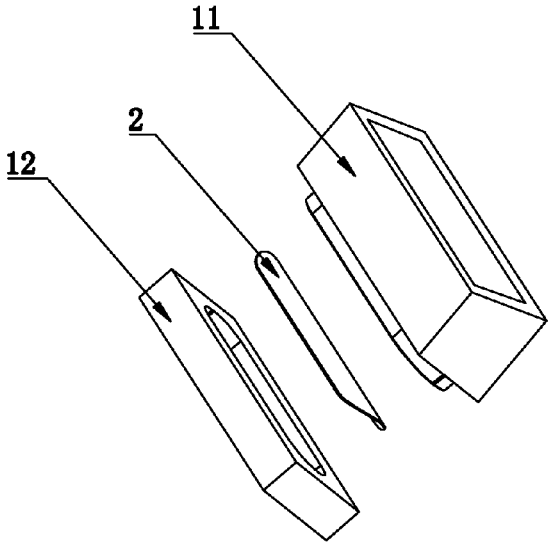
FIG. 1 is an exploded view of the embodiment 1 of the loudspeaker module of the present invention.
Figure 2:
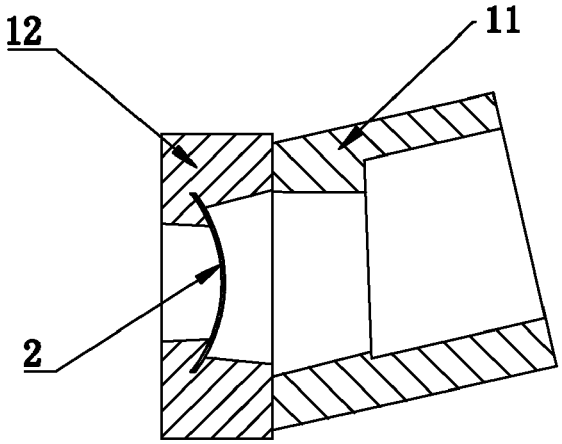
FIG. 2 is a cross-sectional view of the loudspeaker module shown in FIG. 1.

1 and 2, the housing comprises a first housing 11 and a second housing 12. The second housing 12 is provided with a sound hole for radiating sound and a protective net 2 at a position corresponding to the sound hole. The protective net 2 can prevent foreign matters from entering the interior of the loudspeaker module, thereby improving the reliability of the loudspeaker module. As shown in FIGS. 1 and 2, the protective net 2 has a non-planar structure. The non-planar structure of the protective net 2 can offset the external force applied to the housing during the production and application process of the loudspeaker module, or the stress transferred to the protective net 2 due to the deformation of the housing per se, which can avoid the tearing of the protective net 2 or the deformation of the net holes due to the stress of the housing, and ensure that the protective net 2 functions to prevent foreign matters from entering the interior of the loudspeaker module, thereby improving the reliability of the loudspeaker module. As shown in FIGS. 1 and 2, the protective net 2 of the present embodiment is arc-shaped, and in practical application, the protective net 2 may have other non-planar shapes, such as a wavy shape, all of which can reflect the design thought of the loudspeaker module of the invention and realize the advantages of the loudspeaker module of the invention.

As shown in FIG. 2, in the loudspeaker module of the present embodiment, the protective net 2 are integrally joined with the second housing 12. The protective net 2 is integrally joined with the second housing 12 so as to effectively improve the firmness of the joint between the protective net 2 and the housing, and to prevent shedding of the protective net 2 during the production of the loudspeaker module and to ensure the reliability of the loudspeaker module. In the practical production process, the protective net 2 and the second housing 12 may be integrally injection-molded or welded by ultrasonic.

As shown in FIG. 2, the protective net 2 is provided inside the second housing 12. The protective net 2 provided inside the housing is used to prevent the protective net 2 from being scratch by other parts during the production and application of the loudspeaker module, so as to improve the reliability of the loudspeaker module. Meanwhile, the protective net 2 provided inside facilitates the improvement of the aesthetic level of the loudspeaker module.

In practical application, in order to improve the firmness of the protective net 2 per se, the protective net 2 can be a metal net.

Embodiment 2

Figure 3:
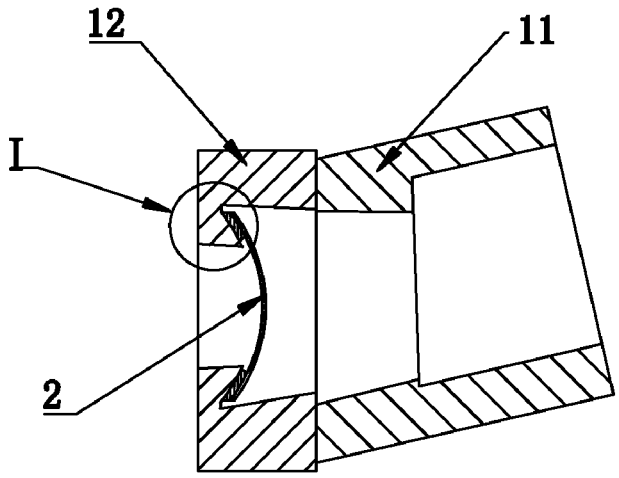
FIG. 3 is a cross sectional view of the embodiment 2 of the loudspeaker module of the present invention.
Figure 4:
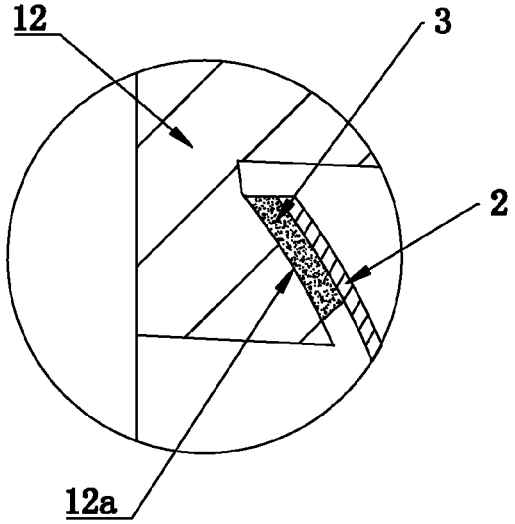
FIG. 4 is an enlarged view of Part I in FIG. 3.

The present embodiment is similar to Embodiment 1, except that the second housing 12 is adhesively fixed to the protective net 2. As shown in FIGS. 3 and 4, the second housing 12 is provided with a bonding surface 12*a* corresponding to the position where the protective net 2 is provided. A portion of the protective net 2 jointed with the bonding surface 12*a* has a shape corresponding to a shape of the bonding surface 12*a*. A colloid 3 is provided between the protective net 2 and the bonding surface 12*a*. The second housing 12 is provided with an bonding surface 12*a*, and a portion of the protective net 2 contacting with the second housing 12 has a shape corresponding to the shape of the bonding surface 12*a*, which make it possible to maximize the contact area between the protective net 2 and the second housing 12, and the colloid is provided therebetween, which make it possible to ensure a firm joint therebetween, so as to improve the firmness of the bonding between the protective net 2 and the second housing 12, thereby improving the reliability of the loudspeaker module.

In the loudspeaker module of the present invention, the protective net has a non-planar structure, and offsets, via deformation thereof, stress of the housing which act on the protective net to cause the tearing of the protective net or the deformation of the net holes, thus improving reliability of the protective net, preventing external foreign matter from entering the interior of the loudspeaker module, and improving reliability of the loudspeaker module.

The above mentioned are only embodiments of the present invention and are not for limiting the present invention, thus the equivalent modification or variation made by those skilled in the art according to the present invention should be incorporated into the protection scope recited in claims.

The invention claimed is:

1. A loudspeaker module, comprising a housing and a loudspeaker unit accommodated in the housing, wherein a sound hole is provided on the housing, and wherein the housing is provided with a protective net at a position corresponding to the sound hole, and the protective net has a non-planar structure, the protective net has an arc shape or a wavy shape, the protective net is provided on an inner side of the housing close to the loudspeaker unit, the protective net is adhesively fixed to the housing, and the housing is provided with a bonding surface at a bonding position corresponding to the protective net, a portion of the protective net contacting with the housing has a shape corresponding to a shape of the bonding surface, and a colloid is provided between the protective net and the bonding surface.

2. The loudspeaker module according to claim 1, wherein the protective net is integral with the housing through injection molding.

3. The loudspeaker module according to claim 1, wherein the protective net is fixed to the housing by ultrasonic welding.

4. The loudspeaker module according to claim 1, wherein the protective net is a metal net.

* * * * *